United States Patent [19]

Weidler et al.

[11] Patent Number: 4,753,615

[45] **Date of Patent: * Jun. 28, 1988**

[54] ELECTRICAL CONNECTION AND FASTENER THEREFOR

[75] Inventors: Charles H. Weidler, Lancaster; James H. Wise, Palmyra, both of Pa.

[73] Assignee: AMP Incorporated, Harrisburg, Pa.

[ * ] Notice: The portion of the term of this patent subsequent to Aug. 4, 2004 has been disclaimed.

[21] Appl. No.: 907,357

[22] Filed: Sep. 15, 1986

Related U.S. Application Data

[63] Continuation-in-part of Ser. No. 880,231, Jun. 30, 1986, Pat. No. 4,684,191.

[51] Int. Cl.[4] ..... H01R 4/28

[52] U.S. Cl. ..... 439/775; 439/883

[58] Field of Search ..... 439/78, 82, 733, 741–743, 439/869, 870, 883, 775; 24/141

[56] References Cited

U.S. PATENT DOCUMENTS

| | | | |
|---|---|---|---|
| 646,738 | 4/1900 | Ingalls | 24/141 |
| 1,106,964 | 8/1914 | Pahler | 24/141 |
| 2,712,201 | 7/1955 | Wintriss | 24/141 |
| 3,766,442 | 10/1973 | Pearce et al. | 439/741 |
| 4,161,174 | 7/1979 | Mercuri | 439/870 |

FOREIGN PATENT DOCUMENTS

| | | | |
|---|---|---|---|
| 0522784 | 8/1921 | France | 439/775 |
| 1307430 | 2/1973 | United Kingdom . | |

*Primary Examiner*—Gil Weidenfeld
*Assistant Examiner*—Gary F. Paumen
*Attorney, Agent, or Firm*—Katherine A. Nelson

[57] ABSTRACT

An electrical connection between high current contact members (26 and 27) is provided by a male and female securing member (10 and 11) of the same coefficient of expansion. The inner surface (21) of a tubular shaft component (19) of the female member (11) and the outer surface (22) of a tubular shaft (18) component of the male member (10) are provided with complementary tapers enabling mating together as a force fit so that plate portions (13 and 12) extending from the root ends of shaft components of respective members (11 and 10) clamp the securing members (26 and 27) therebetween.

In one example, the securing members (41, 41') are identical and hermaphroditic, each shaft component (42 and 42') being of hemicylindrical shape and semicircular cross section, female sockets being defined by apertures (44 or 44') in plates (45 or 45').

14 Claims, 3 Drawing Sheets

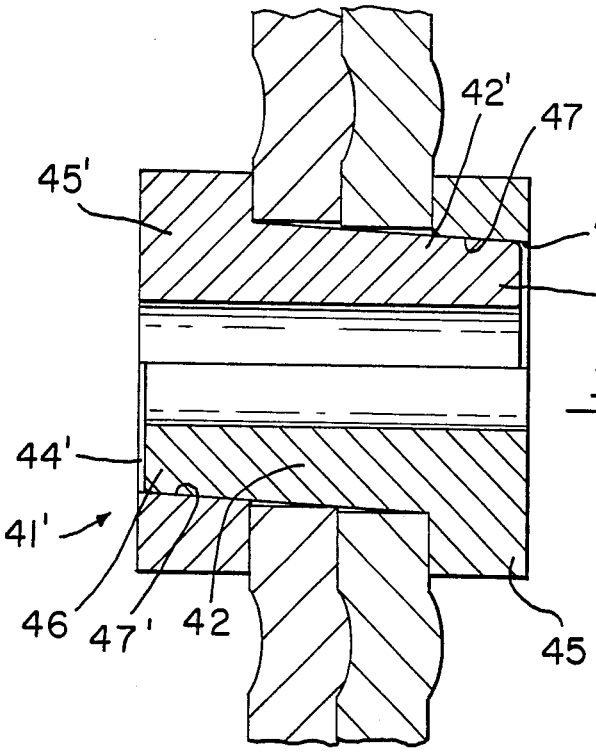
Fig. 6
Fig. 5
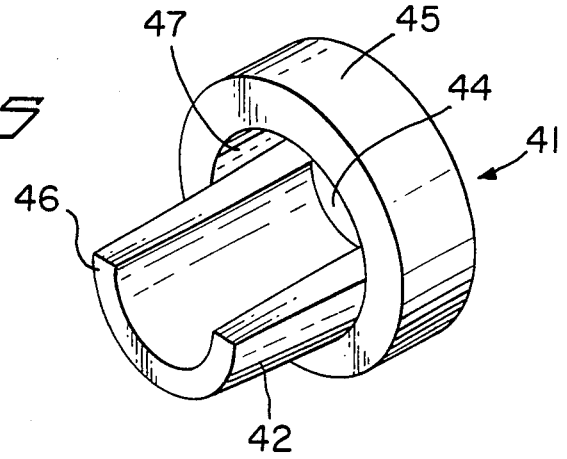

ELECTRICAL CONNECTION AND FASTENER THEREFOR

This application is a continuation-in-part of Application Ser. No. 880,231 filed June 30, 1986, now U.S. Pat. No. 4,684,191, the disclosure of which is incorporated herein by reference.

This invention relates to an electrical connection between high current carrying contact members such as between a bus bar and a terminal of a lead extending from a power supply and to fastening components thereof.

When an electrical power supply is to be connected to a bus bar for supplying power to the bus bar, it is customary for a terminal on an electrical lead extending from, for example, a power supply module to be electrically connected to the bus bar by the clamping action of a bolt in order to connect the circuitry of the module to the bus bar. However, the connection between the lead and the bus bar is subject to temperature cycling, by reason of the heat generated by the current flow, in consequence causing differential expansion between the metal of the bolt and that of the bus bar, thereby loosening the bolt, necessitating periodic readjustment of the bolt to restore the clamping action. Not only in such periodic manual readjustment time-consuming, but it may also require down time of the entire processing unit to which the bus bar supplied power, substantially increasing the overall down time and operational expense.

An object of the invention is to provide an electrical connection which can carry currents sufficiently high for power supplies but which will not require repeated adjustment. In particular, the invention concerns the provision of an electrical connection which will remain effective in spite of temperature fluctuations thereof.

According to one aspect of the invention, an electrical connection comprises male and female securing members, each integrally formed in one piece and of material having matched coefficients of expansion, and including a pair of plates having shaft components outstanding from adjacent faces; contact members having shaft-receiving holes therethrough sandwiched between the plate; the ferrule member defining a socket having an axis extending adjacent its shaft axis and the shaft of the male member being mated as a force fit in the socket, with the plate clamping the contact members together establishing a permanent electrical connection therebetween.

The term "matched" includes both materials having the same coefficients of expansion and in which coefficient of expansion of the material of the female member is less than that of the male member.

As a result of the force fit between the securing members, and the matched coefficients of expansion, the electrical reliability of the connection is maintained throughout temperature fluctuations under normal operating conditions. The current flow between the members is further enhanced by the fasteners themselves providing a current path of low resistance.

In one example, the exterior surface of the shaft of the male member and the interior surface of the socket taper in complementary senses as they extend in the mating direction. This provides a very high proportion of their mating surfaces in wedging engagement optimising the wedging force resisting separation and the current flow.

In a preferred embodiment, the outer surface of the shaft of the female member is provided with a taper which engages the peripheries of the shaft-receiving holes.

In one embodiment, the plates of the male and female members are formed with bolt-receiving through-apertures, and the shaft components cooperate to form a hollow shaft or passageway through which a bolt can extend to fasten the connection to a mounting member.

In a preferred construction, the securing members are identical and hermaphroditic, each shaft component comprising a segment of semicircular cross section, the sockets being formed by apertures in the plates, a free end portion of a shaft component of one member being received in the aperture of the other member, and a second opposition end portion of each shaft component forming a segment of the periphery of the aperture.

Examples of electrical connections according to the invention and components thereof will now be described with reference to the accompanying drawings, in which:

FIG. 1 is a perspective view of a first example of the male and female securing members;

FIG. 2*a* and FIGS. 2*b–d* are sectional views of the male and alternative sizes of the female securing members;

FIG. 5 is a perspective view of an hermaphroditic securing member; and,

FIG. 6 is a schematic cross-sectional view of an electrical connection between two contact members effected by the hermaphroditic securing member.

Figure 1:
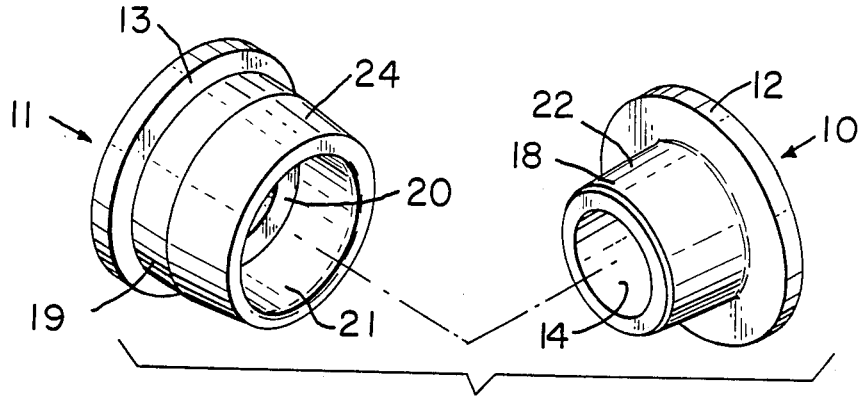

As shown particularly in FIGS. 1, 2*a*, 2*c*, 3 and 4, male and female securing members 10 and 11, respectively, are each formed in one piece of the same material (such as copper) by a conventional manufacturing process (such as sintering or impact extrusion) and comprise a pair of circular plates 12 and 13, respectively, having central bolt-receiving through-apertures 14 and 15, respectively. Tubular shafts 18 and 19, respectively, of circular section outstand from each plate coaxially with the through-apertures 14 and 15, an inner bolt-supporting lip 20 being defined adjacent the root end of the shaft of the female member 11. The shaft 19 of the female securing member 11 forms a socket for the shaft 18 of the male member 10 and has an inner surface 21 of divergent taper, in the mating direction, complementary to an outer surface 22 of the shaft 18 of convergent taper, the lips of the free end portions of shafts 18, 19 also being provided with additional complementary lead-in tapers. An outer surface portion 24 of female shaft 19 is also provided with a small angle of convergent taper extending from a location between a midpoint and its free end.

It will be appreciated that, in alternative examples, the plates and shafts may be discontinuous, for example, of segmented or slotted construction, the plates forming in effect, flanged radial extensions of the shafts.

Figure 3:
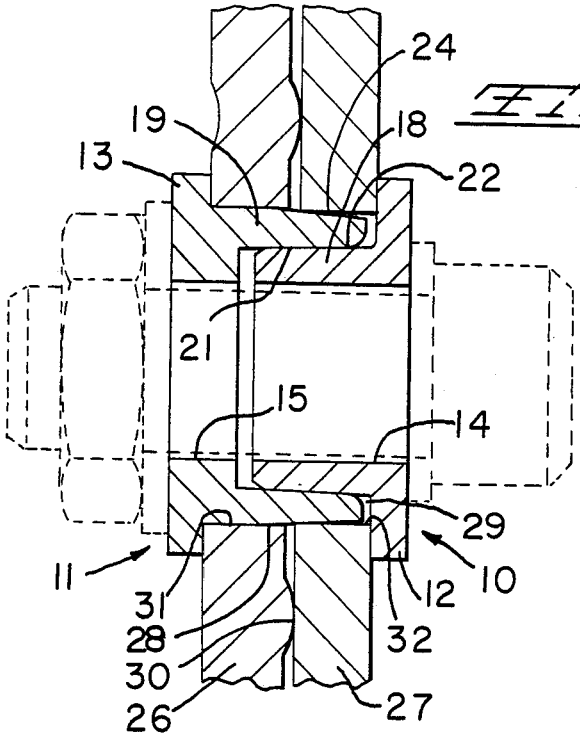
FIG. 3 is a schematic cross-sectional view of an electrical connection between a terminal and a bus bar effected by the securing members.

FIG. 3 shows the use of the fastening members to effect an electrical connection between a ring tongue terminal 26 crimped to a lead extending from a power supply and a bus bar 27. Male and female members 10, 11 are inserted through aperture 28 in the ring tongue terminal 26 and an aperture 29 formed in the bus bar 27 and forced together with a suitable compression tool so that their mating faces 21 and 22 are fixed in wedging engagement, with opposed faces of their plates clamping the terminal 26 and bus bar 27 tightly together. In this condition, the outer surface portions of the female shaft also wedge against peripheral walls 31 and 32, respectively, of apertures 28, 29 in the ring tongue and the bus bar respectively.

Figure 4:
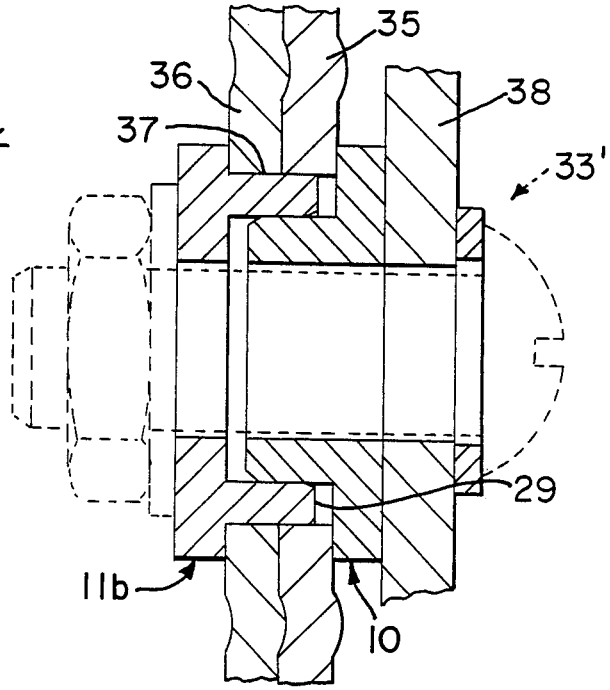
FIG. 4 is a schematic cross-sectional view of an electrical connection between two contact members effected by the securing members and mounted on a mounting member.

If desired, an auxiliary or back-up nut and bolt connection 33 or 33' may be used, as shown in phantom in FIGS. 3 or 4, or more generally to attach a connection between two apertured terminals 35 and 36 to a grounding plane 38, such as a printed circuit board or bus bar, as shown in FIG. 4.

The embodiment of FIG. 4 is closely similar to those described above except that the outer surface 37 of the female member is not tapered and may be used where the dimensions of the apertures of the contact members are known precisely.

A ring of antirotational protuberances 30 may be provided on the ring tongue.

Figure 2A:
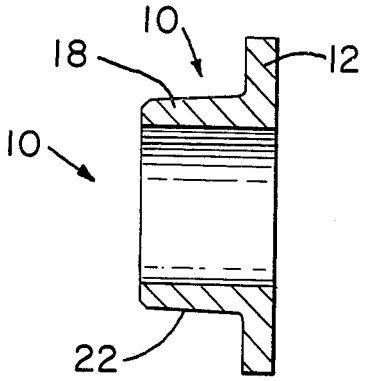
Figure 2B:
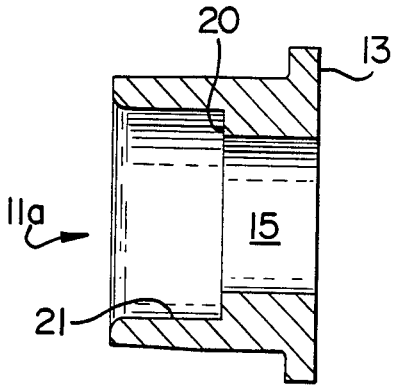
Figure 2C:
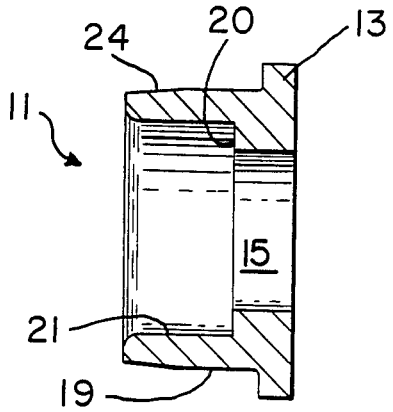
Figure 2D:
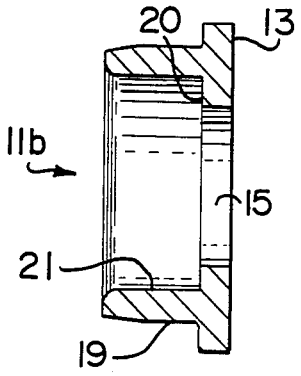

An advantage of the above construction is that a series of similar ferrule fastening members 11*a*, 11, 11*b* of different sizes (as shown in FIGS. 2*b*, 2*c* and 2*d*) can receive a male fastening member of only a single size to accommodate fastening of components of different thicknesses.

In an alternative example, the male fastening element may have a greater coefficient of thermal expansion than the female fastening element thereby to increase the wedging force with the female element as the temperature increases.

In another alternative example, shown in FIGS. 5 and 6, the securing members 41 and 41' are identical and hermaphroditic, each shaft component 42 and 42' being of hemicylindrical shape and of part circular section (similar to that of the parent application), and being received in an aperture 44' or 44 defined in a respective plate 45' or 45 of the other member, so that the tapering free ends 46, 46' form a force fit with the interior peripheral surfaces 47', 47 of the apertures and along abutting edges, thereby clamping two terminals together, as shown most clearly in FIG. 6.

An advantage of this example is that a component of only one type is required, with consequential savings of manufacture, inventory, and assembly costs.

We claim:

1. An electrical connection comprising:

first and second securing members, each of said members being integrally formed in one piece and of material having essentially matched thermal coefficients of expansion, each member including an annular plate portion having a shaft component extending axially outwardly from one face thereof;

a socket portion defined by said first securing member, said socket portion having an aperture extending axially therethrough for receiving the shaft component of said second securing member, said second member shaft component being matable as a force fit in said socket portion;

contact members having shaft-receiving apertures extending therethrough, the shaft component of said first securing member being inserted into said shaft-receiving apertures from one side of said contact members and the shaft component of said second securing member being inserted into said shaft-receiving apertures from the other side of said contact members, said shaft component of said second member being received and mated in said socket portion of said first member, thereby positioning said contact members between respective plate portions of said first and second securing members, and clamping said contact members together and establishing a permanent electrical connection therebetween.

2. The electrical connection as described in claim 1 wherein the exterior surface of the second member shaft component is tapered and the surface of said aperture in said socket portion of said first securing member is provided with a complimentary taper that engages the tapered surface of the tapered shaft component as the first and second securing members are mated.

3. The electrical connection as described in claim 2 wherein the outer surface of the shaft of said first securing member is provided with a taper that engages the peripheries of the shaft-receiving apertures of said contact members.

4. The electrical connection as described in claim 1 wherein said annular plate portions of said first and second securing members are provided with apertures for receiving fastening means therethrough, and said shaft components include cooperating passageways through which fastening means can extend to fasten said connection to a mounting member.

5. The electrical connection as described in claim 1 further comprising an other socket portion defined by said second securing member, said other socket portion having an aperture extending axially therethrough for receiving the shaft component of said first securing member, said first member shaft component being matable as a force fit in said other socket portion.

6. The electrical connection as described in claim 5 wherein said apertures in said socket and said other socket portions are formed in respective plate portions of said first and second securing members and each of said shaft components of said first and second securing members comprises a segment having a semicircular cross section, a free end portion of respective shaft components being received in the corresponding plate apertures of the other member, and a second opposite end of each of said shaft components forming a segment of the periphery of each of said plate apertures.

7. The electrical connection as described in claim 6 wherein said first and second securing members are identical and hermaphroditic.

8. An electrical fastener assembly comprising:

first and second securing members, each of said members being integrally formed in one piece and of material having essentially matched thermal coefficients of expansion, each member including an annular plate portion having a shaft component extending axially outwardly from one face thereof;

a socket portion defined by said first securing member, said socket portion having an aperture extending axially therethrough for receiving the shaft component of said second securing member, said second member shaft component being matable as a force fit in said socket portion;

contact members having shaft-receiving apertures extending therethrough, the shaft component of said first securing member being inserted into said shaft-receiving apertures from one side of said contact members and the shaft component of said second securing member being inserted into said shaft-receiving apertures from the other side of said contact members, said shaft component of said second member being received and mated in said socket portion of said first member, thereby positioning said contact members between respective annular plate portions of said first and second securing members, and clamping said contact members together and establishing a permanent electrical connection therebetween.

9. The electrical fastener assembly as described in claim 8 wherein the exterior surface of the second member shaft component is tapered and the surface of said aperture in said socket portion of said first securing member is provided with a complimentary taper that engages the tapered surface of the tapered shaft component as the first and second securing members are mated.

10. The electrical fastener assembly as described in claim 9 wherein the outer surface of the shaft of said first securing member is provided with a taper that engages the peripheries of the shaft-receiving apertures of said contact members.

11. The electrical fastener assembly as described in claim 8 wherein said annular plate portions of said first and second securing members are provided with apertures for receiving fastening means therethrough, and said shaft components include cooperating passageways through which fastening means can extend to fasten said connection to a mounting member.

12. The electrical fastener assembly as described in claim 8 further comprising an other socket portion defined by said second securing member, said other socket portion having an aperture extending axially therethrough for receiving the shaft component of said first securing member, said first member shaft component being matable as a force fit in said other socket portion.

13. The electrical fastener assembly as described in claim 12 wherein said apertures in said socket and said other socket portions are formed in respective plate portions of said first and second securing members and each of said shaft components of said first and second securing members comprises a segment having a semicircular cross section, a free end portion of respective shaft components being received in the corresponding plate apertures of the other member, and a second opposite end of each of said shaft components forming a segment of the periphery of each of said plate apertures.

14. The electrical fastener assembly as described in claim 13 wherein said first and second securing members are identical and hermaphroditic.

* * * * *